US008475234B2

(12) United States Patent
Ho

(10) Patent No.: US 8,475,234 B2
(45) Date of Patent: Jul. 2, 2013

(54) POWER TOOL HOLDING ARTICLE

(76) Inventor: Yen-Ju Ho, Taiping (TW)

( * ) Notice: Subject to any disclaimer, the term of this patent is extended or adjusted under 35 U.S.C. 154(b) by 849 days.

(21) Appl. No.: 12/567,795

(22) Filed: Sep. 27, 2009

(65) Prior Publication Data

US 2011/0076927 A1 Mar. 31, 2011

(51) Int. Cl.
*B24B 41/04* (2006.01)

(52) U.S. Cl.
USPC ..... 451/342; 451/360; 451/508

(58) Field of Classification Search
USPC ..... 83/651; 173/132; 451/341, 342, 451/360, 508
See application file for complete search history.

(56) References Cited

U.S. PATENT DOCUMENTS 6,796,888 B2 9/2004 Jasch
6,945,862 B2 9/2005 Jasch et al.
8,151,679 B2 * 4/2012 Bohne ..... 83/698.11

* cited by examiner

*Primary Examiner* — Timothy V Eley
(74) *Attorney, Agent, or Firm* — Muncy, Geissler, Olds & Lowe, PLLC

(57) ABSTRACT

A power tool holding article is provided and fastened to a power output element by clamping. The power output element has a fastening portion which has at least one protrusive fastening element to hold the holding article. The holding article has an article body and a mating portion connecting to the article body. The mating portion has a plurality of bulged elements spaced from each other to form a plurality of holding spaces. The protrusive fastening element of the fastening portion is engaged with the holding spaces to hold the holding article. Thus no special-shaped drilling openings are needed on the holding article. It can mate power output elements made by varying producers to reduce cost and improve compatibility.

10 Claims, 8 Drawing Sheets

POWER TOOL HOLDING ARTICLE

FIELD OF THE INVENTION

The present invention relates to a holding article and particularly to a detachable power tool holding article.

BACKGROUND OF THE INVENTION

Power tools with a detachable holding article are convenient and widely used at present. How to assemble and disassemble a power output element faster, easier, safer and firmer is a high priority issue in the industry. Many techniques have been proposed in recent years. For instance, U.S. Pat. Nos. 6,945,862 and 6,796,888 disclose a power tool having a receptacle for securing a tool. Referring to FIG. 1, the aforesaid two patents disclose a power tool holding article 1 fastened to a power output element 3*a* by clamping. The holding article 1 has an opening 2 formed in a special shape to mate a protrusive fastening portion 4*a* located above the power output element 3*a*. The holding article 1 can be fastened securely to the power output element 3*a* through a fastening element 8 to generate powerful spinning or vibration.

FIG. 2 illustrates another type of holding tool. It has a power output element 3*b* with a bulged fastening portion 4*b* formed on a hollow transmission shaft 5 and arranged radially from the center of the transmission shaft 5. A cutter 6 is provided with a plurality of apertures 7 formed thereon mating the bulged fastening portion 4*b*, and fastened to the power output element 3*b* through a fastening element 8. Thus the cutter 6 can be safely and firmly held to produce powerful spinning or vibration through the power output element 3*b*. The opening 2 of the special shape or apertures 7 must be formed through a special drilling machine. Hence the costs of the holding article 1 and cutter 6 are higher. Moreover, the holding article 1 shown in FIG. 1 is not adaptable to the power output element 3*b* shown in FIG. 2. The holding article 1 or cuter 6 has to be made differently among different power tool producers. As a result, compatibility suffers.

SUMMARY OF THE INVENTION

The primary object of the present invention is to reduce production cost of power tool holding articles and improve compatibility in specifications of varying producers.

To achieve the foregoing object, the present invention provides a power tool holding article fastened to a power output element by clamping. The power output element has a fastening portion which has at least one protrusive fastening element to hold the holding article.

The invention provides features as follow: the holding article has an article body and a mating portion connecting to the article body. The mating portion has a plurality of bulged elements that are spaced from each other to form a plurality of holding spaces mating the fastening portion. The protrusive fastening element is engaged in the holding spaces to securely hold the holding article.

By means of the construction set forth above, the holding article mates the power output element and has multiple bulged elements to form the holding spaces to securely hold the protrusive fastening element, so that the protrusive fastening element is engaged in the holding spaces to securely hold the holding article. The holding space can mate the fastening portion with different types. Moreover, there is no need to form the special opening or apertures on the holding article. Only one round coupling opening in a basic specification is required to engage with the power output element. Thus production cost is lower and compatibility improves.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
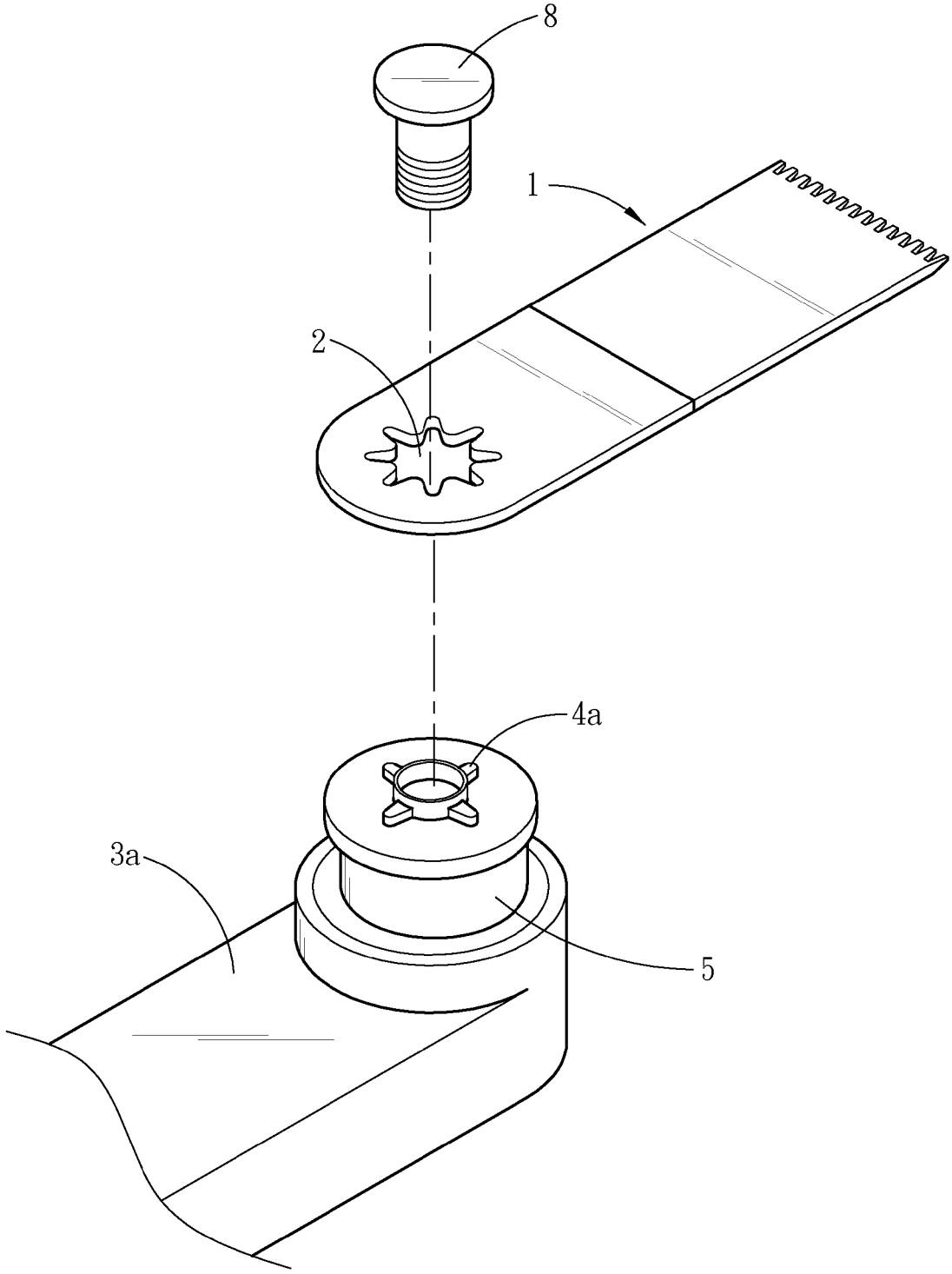
Fig. 1 PRIOR ART
FIG. 1 is a schematic view of a conventional power tool with a mating holding article.
Figure 2:
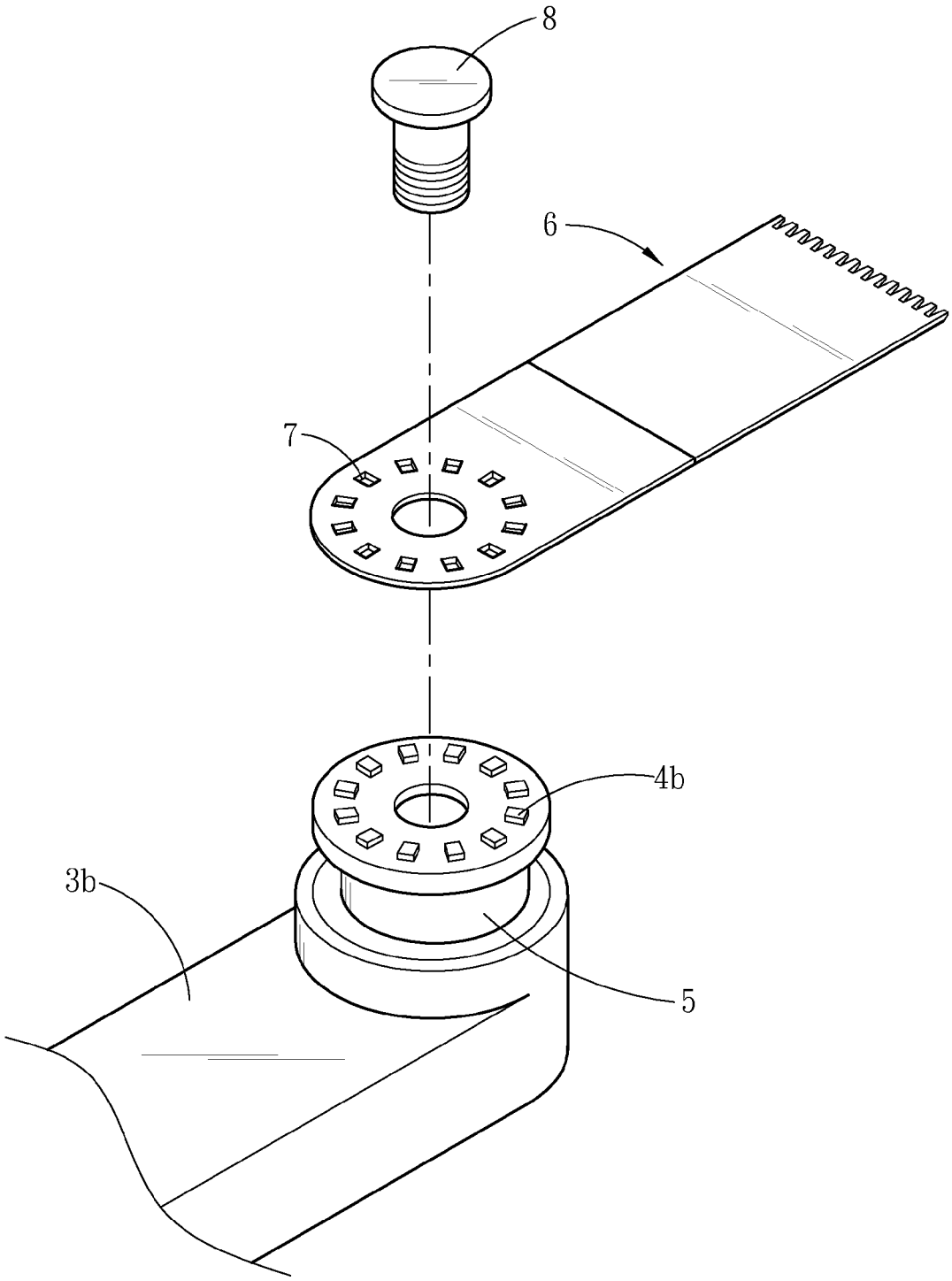
Fig. 2 PRIOR ART
FIG. 2 is a schematic view of another conventional power tool with another mating holding article.
Figure 3:
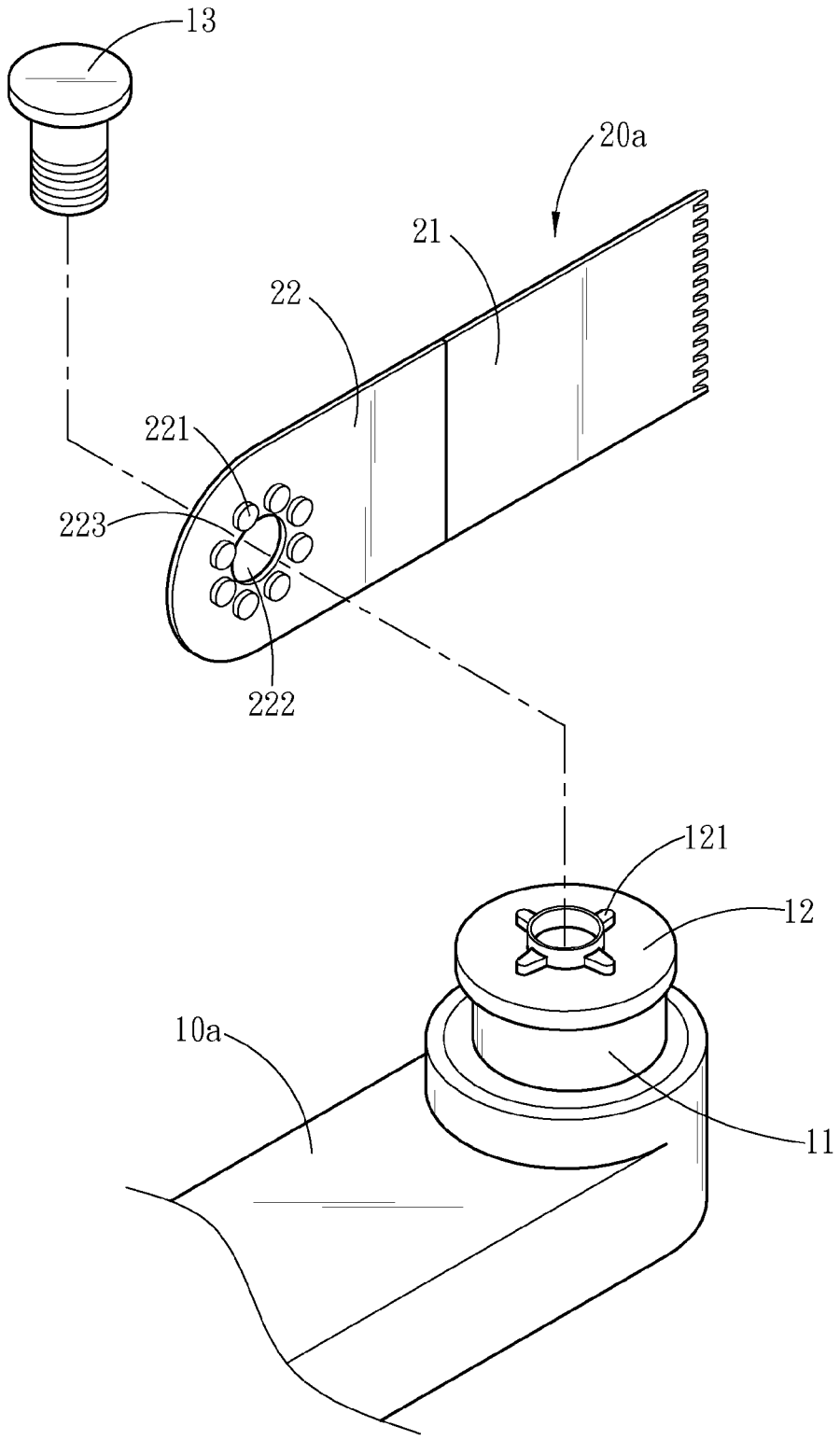
FIG. 3 is a schematic view of an embodiment of the invention showing a power output element with a mating holding article.

Please refer to FIG. 3 for an embodiment of the invention. The power tool holding article 20*a* according to the invention is fastened to a power output element 10*a* by clamping and detachable and replaceable to mate varying operation requirements. The power output element 10*a* has a hollow transmission shaft 11 to provide and output power, a fastening portion 12 located on the transmission shaft 11 and a fastening element 13 to fasten the holding article 20*a*. The fastening portion 12 has at least one protrusive fastening element, formed in four jutting fastening tips 121 in the embodiment. The fastening tips 121 are formed in pairs and extended outwards diagonally from the axis of the transmission shaft 11 to become a cross-shaped structure The holding article 20*a* has an article body 21 and a mating portion 22 connecting to the article body 21. The mating portion 22 has a plurality of bulged elements 221 and a coupling opening 222. In this embodiment, the bulged elements 221 are circular and spaced from each other to form a plurality of holding spaces 223 between them to mate the fastening tips 121 to form engagement therewith. Hence the holding article 20*a* can be positioned on the fastening portion 12, and the fastening element 13 runs through the coupling opening 222 to couple with the transmission shaft 11 to secure the holding article 20*a* on the power output element 10*a*. In this embodiment, the bulged elements 221 are formed at a number double the fastening tips 121 to provide more engaging angles of the fastening portion 12 so that more angular selections can be formed between the article body 21 and the power output element 10*a* to meet user's requirements or operation needs or article profiles to change the angle between the article body 21 and the power output element 10*a* as desired to facilitate operation.

Figure 4:
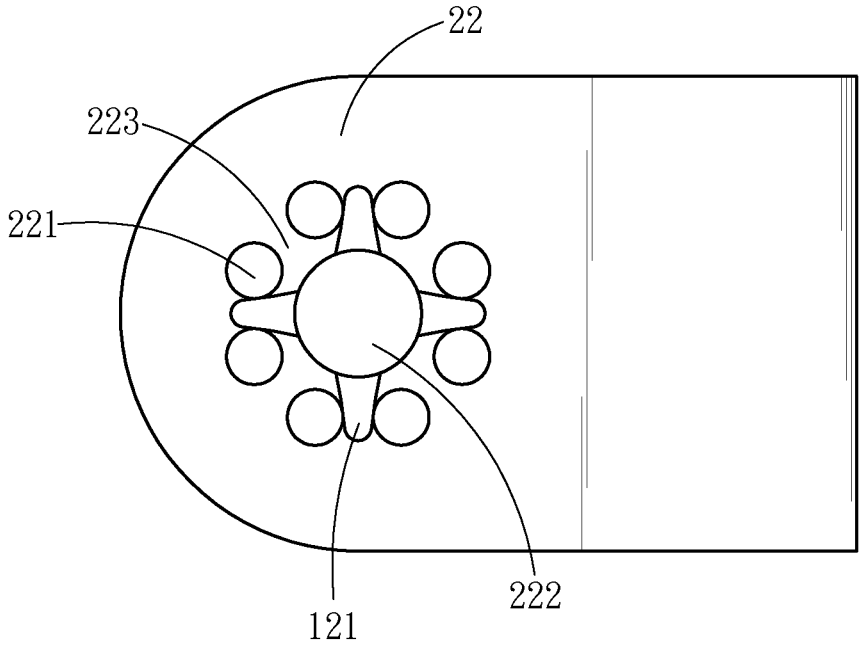
FIG. 4 is a schematic view of an embodiment of the invention in a coupling condition.

The fastening element 13 and the transmission shaft 11 may have screw threads formed on the engaging surfaces to form fastening by screwing so that the holding article 20*a* can be firmly held on the power output element 10*a*. Also referring to FIG. 4, when in a coupling condition, the fastening tips 121 are engaged with the holding spaces 223 formed by the bulged elements 221 to form a secure holding structure.

In the embodiment previously discussed, the article body 21 is a rectangular saw piece. It also can be a cutter, or a grinding element or a steel brush formed in a bow shape, a square shape, a circular shape, a triangular shape, an arched shape or a combination thereof. The mating portion 22 can be connected to the article body 21 or formed by extending from the article body 21. In addition, the bulged elements 221 can also be formed by extending from the mating portion 22 in an integrated manner.

Figure 5:
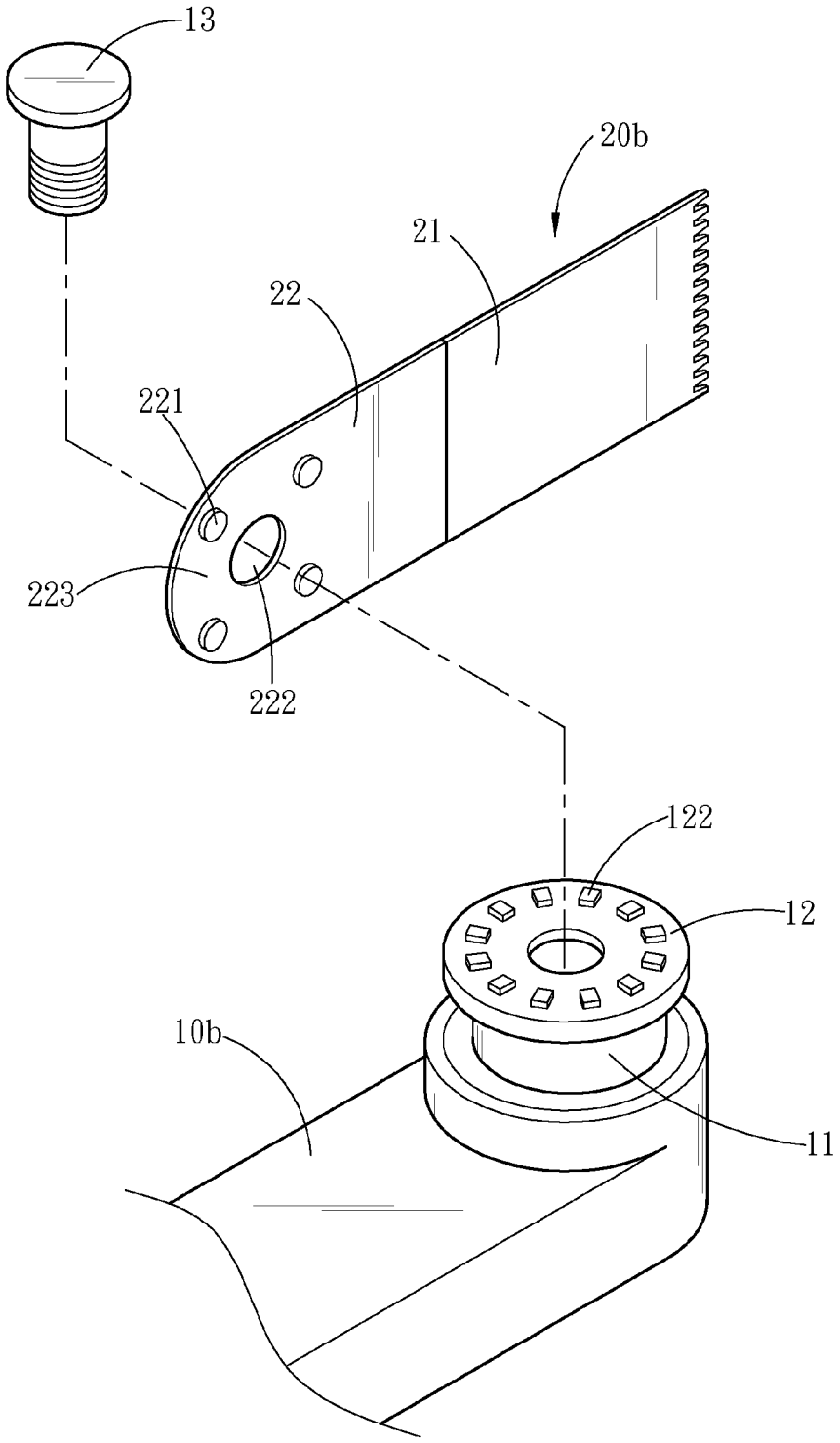
FIG. 5 is a schematic view of another embodiment of the invention showing a power output element with a mating holding article.

Refer to FIG. 5 for another embodiment of the invention that is a variation from the one previously discussed. The fastening portion 12 has a plurality of fastening bosses 122 arranged radially from the axis of the transmission shaft 11 to mate another power output element 10*b* provided by another producer. The holding article 20*b* also is altered to mate the power output element 10*b*. The holding article 20*b* has an article body 21 and a mating portion 22 connecting to the article body 21. The mating portion 22 has a plurality of bulged elements 221 and a coupling opening 222. In this embodiment, the bulged elements 221 are circular and spaced from each other to form a plurality of holding spaces 223 between them to mate the fastening bosses 122. Therefore, the fastening bosses 122 can be engaged with the holding spaces 223 to securely hold the holding article 20*b* on the fastening portion 12, while the fastening element 13 runs through the coupling opening 222 to connect to the hollow transmission shaft 11. Thus the holding article 20*b* can be firmly held on the power output element 10*b*.

Figure 6:
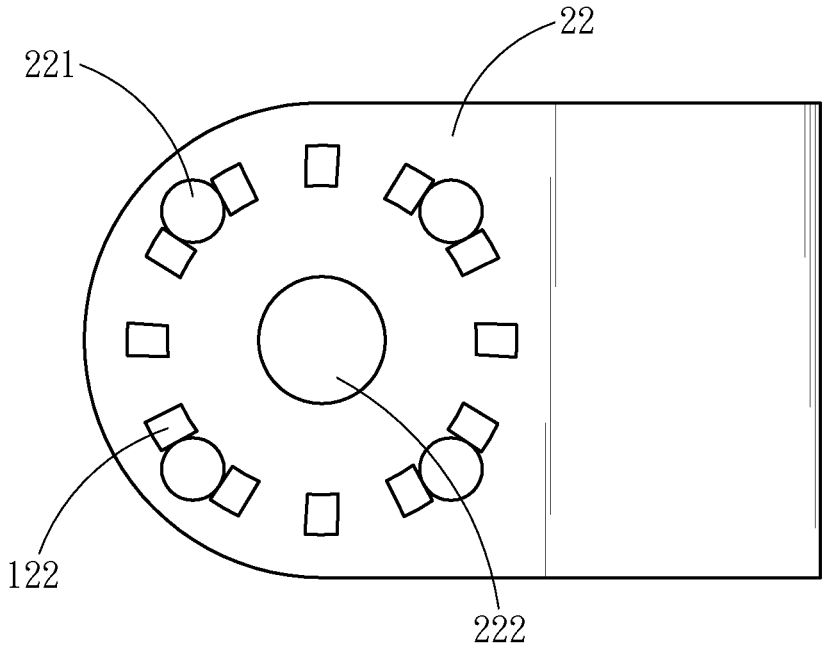
FIG. 6 is a schematic view of another embodiment of the invention in a coupling condition.

In this embodiment, the engaging angle between the holding article 20*b* and the power output element 10*b* can be changed to alter the angle between the article body 21 and the power output element 10*b* to meet user's requirements or operation needs or article profiles to change the angle between the article body 21 and the power output element 10*b* as desired to facilitate operation. Moreover, the fastening element 13 and the transmission shaft 11 may have screw threads formed on the engaging surfaces to form fastening by screwing so that the holding article 20*b* can be firmly held on the power output element 10*b*. Also referring to FIG. 6, when in a coupling condition, the fastening bosses 122 are engaged with the corresponding bulged elements 221 to form a secure holding structure.

Figure 7:
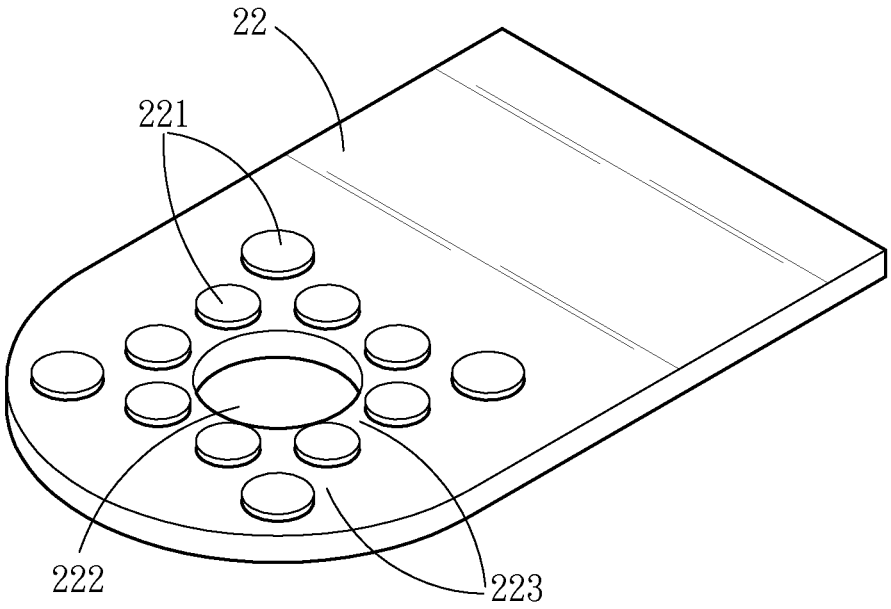
FIG. 7 is a schematic view of an embodiment of a common holding article.
Figure 8:
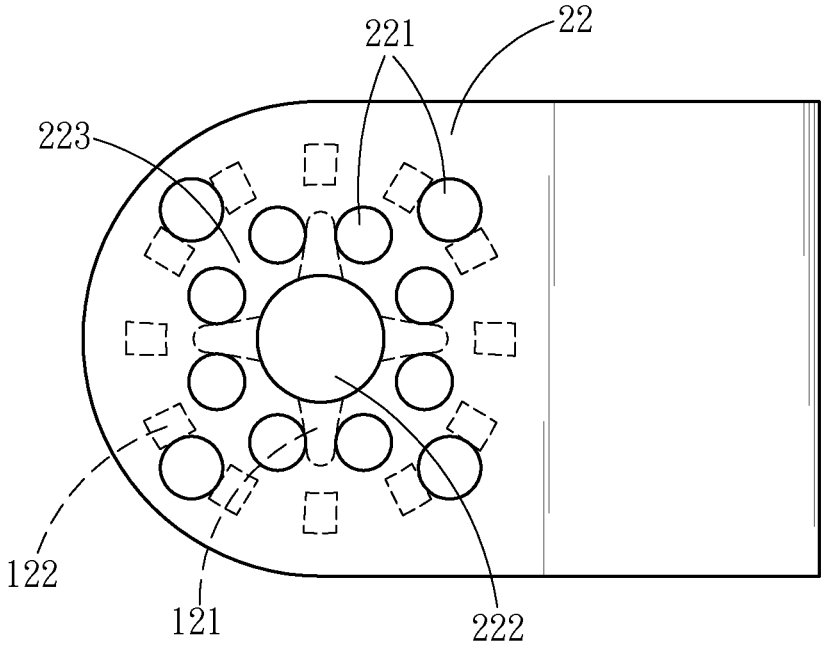
FIG. 8 is a schematic view of an embodiment of a compatible common holding article in a coupling condition.

Refer to FIGS. 7 and 8 for an embodiment of a common holding article. It has a mating portion 22 to mate the fastening tips 121 and fastening bosses 122 at the same time. The mating portion 22 has the bulged elements 221 formed radially from the center of the coupling opening 222 and spaced from each other to form the holding spaces 223 to mate the specifications of the fastening tips 121 and the fastening bosses 122. Thus the invention can be used both on the power output element 10*a* with the fastening tips 121 and another power output element 10*b* with the fastening bosses 122.

As a conclusion, the present invention provides a holding article to mate a power output element. The holding article has a plurality of bulged elements spaced from each other to form holding spaces to mate a protrusive fastening element on the power output element to form secure engagement therewith. The holding spaces can mate the fastening portion of different types and shapes. Moreover, no special-shaped opening is required on the holding article. Only one basic round coupling opening is needed to receive the fastening element to fasten the holding article on the power output element. As a result, production cost is lower and compatibility improves. It offers a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A power tool holding article for fastening to a power output element by clamping, the power output element having a fastening portion which has at least one protrusive fastening element to hold the holding article, the holding article comprising:

an article body and a mating portion connecting to the article body, the mating portion having a connect surface corresponding to the fastening portion, a plurality of bulged elements protruding along a direction from the connect surface to the fastening portion when the holding article is fastened to the power output element, and a plurality of holding spaces formed between the bulged elements to mate and engage with the protrusive fastening element to allow the fastening portion to hold the holding article.

2. The power tool holding article of claim 1, wherein the power output element has a hollow transmission shaft to output power and a fastening element to hold the holding article, the holding article having a coupling opening to receive the fastening element to connect to the transmission shaft, the fastening element clamping the holding article on the power output element through the coupling opening.

3. The power tool holding article of claim 2, wherein the protrusive fastening element is a plurality of fastening tips extended outwards from an axis of the transmission shaft.

4. The power tool holding article of claim 3, wherein the bulged elements are formed at a number twice the number of the fastening tips.

5. The power tool holding article of claim 2, wherein the protrusive fastening element is a plurality of fastening bosses located radially on the fastening portion from an axis of the transmission shaft.

6. The power tool holding article of claim 1, wherein the article body is selected from the group consisting of a cutter, a grinding element and a steel brush.

7. The power tool holding article of claim 1, wherein the article body is formed in a shape selected from the group consisting of a bow, a square, a circle, a triangle, an arched shape and a combination thereof.

8. The power tool holding article of claim 1, wherein the mating portion is extended from the article body in an integrated manner.

9. The power tool holding article of claim 1, wherein the bulged elements are formed by extending from the mating portion in an integrated manner.

10. The power tool holding article of claim 1, wherein the bulged elements of the mating portion are circular.

* * * * *